US005595038A

United States Patent [19]

Prestenback

[11] Patent Number: 5,595,038

[45] Date of Patent: Jan. 21, 1997

[54] CONSTRUCTION MODULES

[76] Inventor: Alfred Prestenback, 122 Sharlene St., Houma, La. 70364

[21] Appl. No.: 408,046

[22] Filed: Mar. 21, 1995

[51] Int. Cl.[6] ..... F04B 2/08

[52] U.S. Cl. ..... 52/592.1; 52/588.1; 52/481.1; 52/309.9; 52/592.4

[58] Field of Search ..... 52/588.1, 539, 52/592.1–592.4, 309.7, 309.9, 543, 481.1

[56] References Cited

U.S. PATENT DOCUMENTS

| | | | |
|---|---|---|---|
| 2,164,681 | 7/1939 | Fould | 52/588.1 X |
| 3,633,647 | 1/1972 | Leitgeb | 52/588.1 X |
| 3,760,568 | 9/1973 | Sauer et al. | 52/592.1 |
| 3,992,834 | 11/1976 | Valenzano | 52/594 X |
| 4,104,837 | 8/1978 | Naito | 52/588.1 X |
| 4,236,366 | 12/1980 | Rijnders | 52/592.1 X |
| 4,316,351 | 2/1982 | Ting | 52/309.9 |
| 4,550,543 | 11/1985 | Valenzano | 52/309.7 |
| 5,410,855 | 5/1995 | Clausen et al. | 52/592.1 X |
| 5,411,782 | 5/1995 | Jarvis et al. | 52/588.1 X |

FOREIGN PATENT DOCUMENTS

| | | | |
|---|---|---|---|
| 0330105 | 7/1983 | Germany | 52/592.2 |

*Primary Examiner*—Carl D. Friedman
*Assistant Examiner*—Winnie Yip
*Attorney, Agent, or Firm*— Keaty & Keaty

[57] ABSTRACT

This invention relates to a construction module which is designed to interconnect with similarly constructed modules to form a structure, such as, a wall or a fence. The construction module is formed by a continuous sheet of extrudable material which is bent at different angles, so as to define a three-portion module. The first, open-end portion is formed by a pair of plates having converging extensions which define a passageway leading into the space between the plates. The second portion has a substantially reduced width suitable for fitting into the passageway of an abutting module. The third, closed end portion is smaller in width than the space between the plates allowing the third portion to fit into the space between the plates of the abutting module and receive upwardly extending tips of the converging extensions in corresponding grooves.

11 Claims, 4 Drawing Sheets

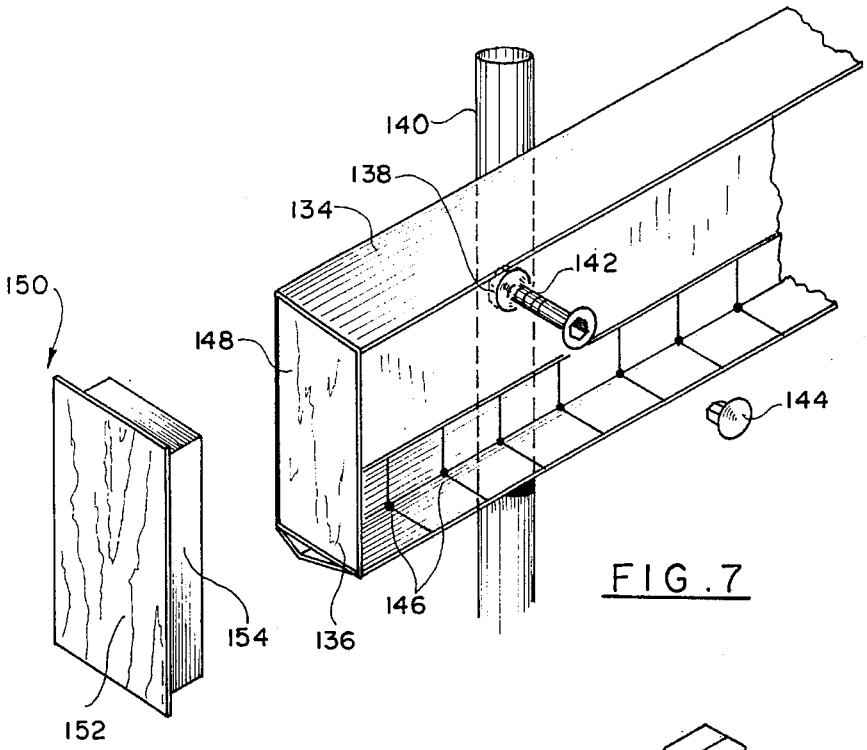
FIG. 7
FIG. 8
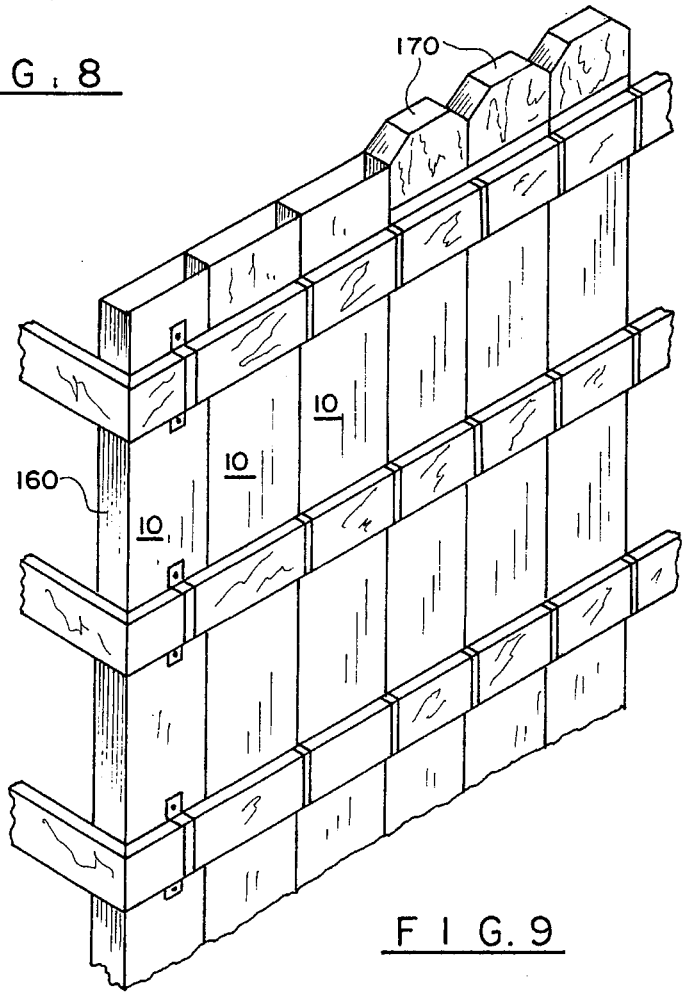
FIG. 9
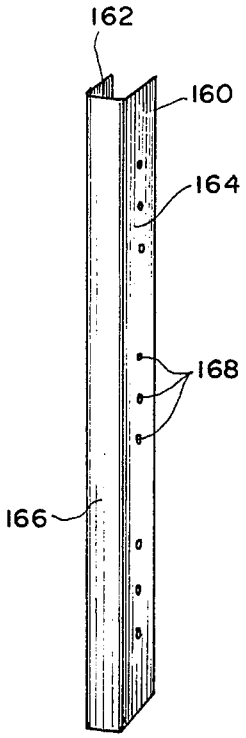
FIG. 10

CONSTRUCTION MODULES

BACKGROUND OF THE INVENTION

This invention relates to construction industry, and more particularly to a system for building of walls, fences and other similar structures from pre-fabricated modules.

The use of pre-fabricated modules is widely recognized in the construction industry. Some of the construction forms are designed to allow building of structural elements suitable for carrying utility conduits and supports for cables, insulation, water and the like. Examples of such construction forms can be found in U.S. Pat. No. 3,992,834 issued on Nov. 23, 1976 and U.S. Pat. No. 4,550,543 issued on Nov. 5, 1985. The construction forms in accordance with the above patents are composed of a plurality of cells with the ends of the cells biased to include 45 degree male-female miter elements. The pre-fabricated structural assemblies have side walls and biased end terminations to allow fitting of the forms together for the purpose of constructing a structure of a desired shape.

It is also important to have construction elements which are resistant to mildew and other atmospheric damage, especially if the construction elements are to be used mainly for erecting outdoor structures. To this end, the present invention contemplates provision of a pre-fabricated module which is resistant to atmospheric damage and which can be used, in combination with other similar modules, for erecting a fence, a wall or other similar structure.

SUMMARY OF THE INVENTION

It is, therefore, an object of the present invention to provide a construction module which is pre-fabricated and delivered to the construction cite ready for immediate installation.

It is a further object of the present invention to provide a construction module which is resistant to atmospheric damage under normal conditions.

It is a further object of the present invention to provide a construction module which is easy to install and inexpensive to manufacture.

It is a further object of the present invention to provide a construction module which, in combination with other similar modules, can be used for erecting an aesthetically pleasing structure.

These and other objects of the present invention are achieved through a provision of construction module which is formed from a continuous sheet bent at a plurality of angles and/or curves to allow interconnecting of the construction modules. Each construction module is comprised of a pair of spaced-apart elongated plates which have angularly oriented extensions at both ends. One of the ends of the construction module is open and is formed by converging portions of the plate. The converging portions form a narrow passageway which communicates with a space between the plates.

The second end of the construction module is closed and has a width substantially smaller than the space between the plates, allowing the closed end of one construction module to fit between spaced-apart plates of an abutting construction module. The box-like closed end is connected to the spaced-apart plates by a connecting element which has a width smaller than both the space between the elongated plates and the closed end. This connecting portion fits into the space defined by the passageway of the open end of the abutting construction module.

The converging extensions of the open end of the module have outwardly extending tips which fit into corresponding grooves formed in the closed end of the abutting construction module.

By interconnecting several modules with each other, through sliding of the closed end portion and the connecting element portion into the space between the plates, a desired structure, for example, a fence, or a wall, can be easily and inexpensively built.

BRIEF DESCRIPTION OF THE DRAWINGS

Reference will now be made to the drawings, wherein like parts are designated by like numerals, and wherein:

FIG. 7 is a perspective detail view illustrating the manner of securing a horizontal board of FIG. 5 to a vertical post.

FIG. 8 is a perspective view of an end cap.

FIG. 9 is a perspective view of a fence erected with the use of construction modules in accordance with the present invention.

FIG. 10 is a perspective view of an end plate for use with a fence structure shown in FIG. 9.

DETAILED DESCRIPTION OF THE PREFERRED EMBODIMENT

Figure 1:
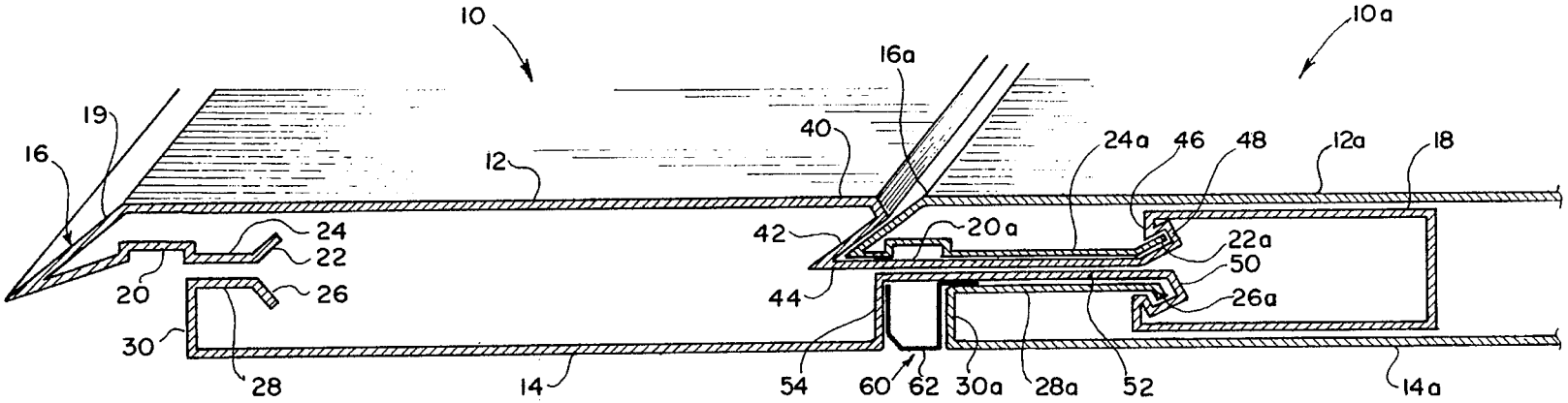
FIG. 1 is a detail, part cross-sectional view of two construction modules fitted together.

Turning now to the drawings in more detail, numeral 10 designates a construction module in accordance with the first embodiment of the present invention. The module 10 comprises an interior plate 12, and exterior plate 14, a first open end 16, and a second closed end 18. The opposing parallel sides 12 and 14 are formed as substantially protrusion free, smooth surfaces suitable which can be colored for giving an aesthetically pleasing view to the structure.

A first, open end 16 is defined by an angular V-shaped nose portion 19 which is integrally connected to the interior plate 12 and which is oriented at an angle to the transverse axis of the interior plate 12. The first end 16 further comprises a recess 20 which is defined by a continuation of the nose portion 19, formed as an integral part of the first end 16. The first end 16 further comprises a flaring out tip 22 which is formed at an angle to a converging connecting element 24, with the element 24 being oriented in substantially parallel relationship to the interior plate 12.

A mirror image of the flaring tip 22 is formed by an opposing tip 26 which is bent at an angle opposing that of the flaring tip 22 and is similarly retained by a converging connecting element 28 which is a mirror image of the connecting element 24. A transverse element 30 is integrally formed as a continuation of the connecting element 28, the element 30 being oriented in a perpendicular relationship to the connecting element 28, as well as to the plates 12 and 14. The element 30 is integrally connected to the plate 14 at the first end 16.

The opposite end of the plate 12 is formed with a V-shaped recess 40 defined by portions 42 and 44. The portion 44 is oriented in a substantially parallel relationship to the sides 12 and 14. The portion 44 continues and forms one of the grooves in the closed end 18. The groove 46 is adapted to receive a flaring member 22*a* of an abutting module 10*a*. The portion which defines the U-shaped groove 46 is generally designated by numeral 48 in FIG. 1.

The second end 18 of the module 10 forms a box-like structure with another U-shaped groove 50 being a mirror image of the groove 46. The end 18 is smaller in width than the space between the plates 12*a* and 14*a* of the abutting module 10*a*, allowing the end 18 to fit within the interior of the module 10*a*, with the flaring out tips 22*a* and 26*a* engaged within the respective grooves 46 and 50.

The second end 18 is integrally connected to a plate 52 which is spaced from the plate 44 and is oriented in parallel relationship thereto. The plates 44 and 52 form a middle portion of the module 10. The distance between the plates 44, 52 is smaller than the distance between the converging members 24*a* and 28*a* of the abutting module 10*a*.

A transverse element 30*a* of the module 10*a*, similar to the connecting element 30, is oriented at a right angle to the connecting element 28*a* and the side 14*a*.

The plate 52 terminates at a transverse part 54 which is integrally connected to the plate 14 and which is formed at a right angle to the plate 52 and to the side 14. As can be seen in the drawing, a gap 60 is formed between the transverse members 30*a* of the abutting member 10*a* and the transverse part 54 of the module 10.

To prevent water from entering between the modules 10 and 10*a* and to fill the gap, a gap filling structural member 62 is provided. (see FIG. 2) The structural member 62 comprises a U-shaped trough 64 having a transverse flange 66 formed at one end thereof. The flange 66 is adapted to fit in a space between the plate 52 and the connecting member 28*a*, as shown in FIG. 1.

The modules 10 and 10*a* can be constructed from a single sheet of a moldable material, such as plastic, with the mold having necessary characteristics to execute the grooves and angular relationships between the elements and plates forming the modules 10 and 10*a*. When the modules 10 and 10*a* are fitted to each other, the first end 16*a* of the module 10*a* is fitted within the V-shaped recess 40 of the module 10, and the flaring out tips 22*a* and 26*a* within the grooves 46 and 50 of the module 10.

Figure 2:
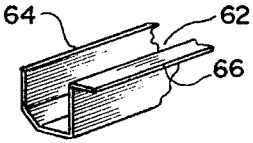
FIG. 2 is a perspective detail view of a gap-filling element for use with the modules in FIG. 1.

Even though the open ends 16 and 16*a* are not identically sized in FIG. 1, a person skilled in the art will appreciate that various sizes of the ends 16 and 18 can be utilized for fitted engagement of the adjacent modules.

The indentation 20 is adapted to receive a securing element, for example nail or screw, for attachment of the end 16 to a horizontal board of a fence or other suitable structure.

The structural integrity of the module 10 is enhanced by the box-like enclosure of the second end 18 which fits within the space between the plates 12 and 14.

Figure 3:
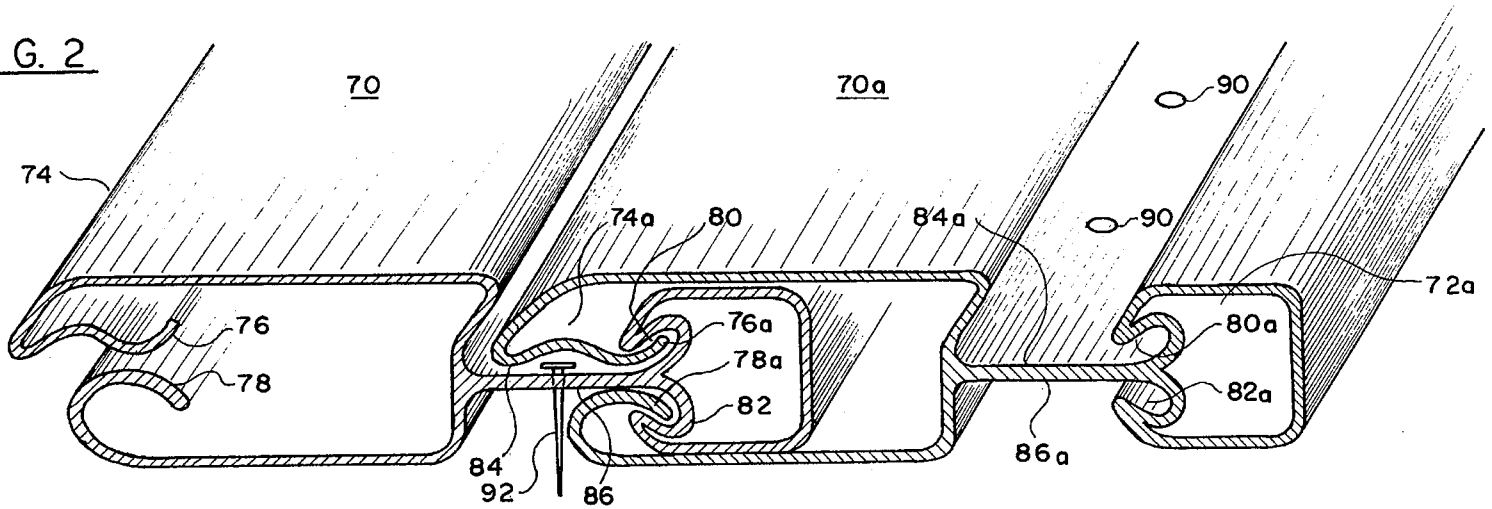
FIG. 3 is a perspective view of an alternative embodiment of the construction module in accordance with the present invention.

Turning now to FIG. 3, the second alternative embodiment of the construction module in accordance with the present invention is illustrated. This embodiment provides for the use of more rounded connecting ends which, under certain conditions, may be easier to manufacture than the sharp angles of the embodiment shown in FIG. 1. As seen in FIG. 3, two adjacent modules 70 and 70*a* are interconnected with each other by fitting a second end 72 of the module 70 within the module 70*a*. Similarly to the embodiment of FIG. 1, modules 70 and 70*a* have outwardly extending first ends 74 and 74*a*, respectively. The ends 74 and 74*a* are formed by first converging and then flaring portions 76, 78 and 76*a*, 78*a*. The outwardly flaring tips 76*a* and 78*a* are adapted to fit within groove 80 and 82 defined by the end 72 of an abutting module 70*a*. In this manner, the first end of the module 70 is engaged with the second end of the module 70*a*.

A narrow middle portion is formed by elongated parallel plates 84, 86 and 84*a*, 86*a*. Formed in the plates 84, 86 and 84*a*, 86*a* are a plurality of openings 90 adapted to receive a securing element, for example a nail, or screw 92, therethrough. The nails or screws 92 are used to secure the modules 70 and 70*a* to the horizontal boards or vertical posts of such structure as a fence.

Figure 4:
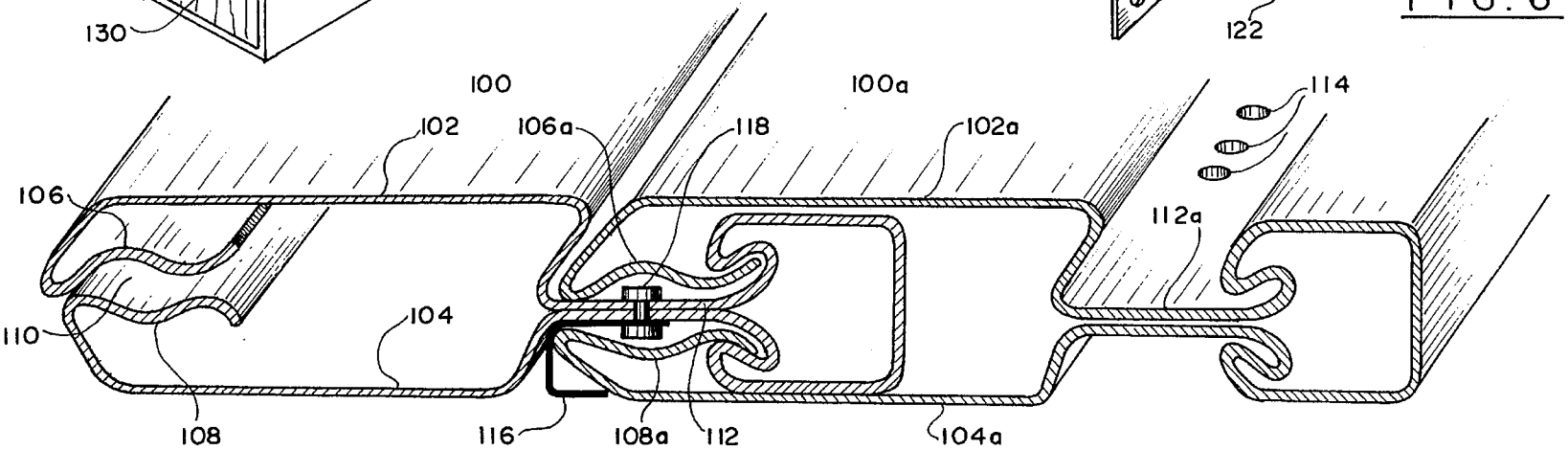
FIG. 4 is a perspective view of a third embodiment of the construction module in accordance with the present invention.

Turning now to FIG. 4, a third embodiment of the construction modules in accordance with the present invention is illustrated. As shown in FIG. 4, modules 100 and 100*a* are formed, similarly to the modules 10, 10*a*, 70 and 70*a* with elongated parallel plates 102, 104 and 102*a*, 104*a*, respectively. A first open end 106 of the module 100 is formed by converging mirror-image portions 106 and 108. The portions 106 and 108 define a large recess 110 for receiving a narrow connecting member 112 therethrough. The member 112 is formed by a pair of parallel connecting plates which are continuous of the plates 102 and 104. The connecting member 112 is provided with a plurality of apertures 114 suitable for receiving a securing element, for example bolts and nuts, or rivets, attached to the fence rail strip, or bracket 116 which are shown in more detail in FIGS. 5 and 6. A schematic illustration of a rivet 118 is shown in FIG. 4.

Figure 6:
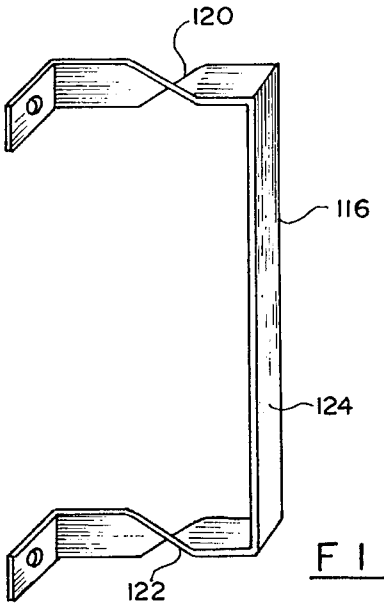
FIG. 6 is a detail view of a bracket used for supporting a construction module in accordance with the present invention to a horizontal board of FIG. 5.
Figure 5:
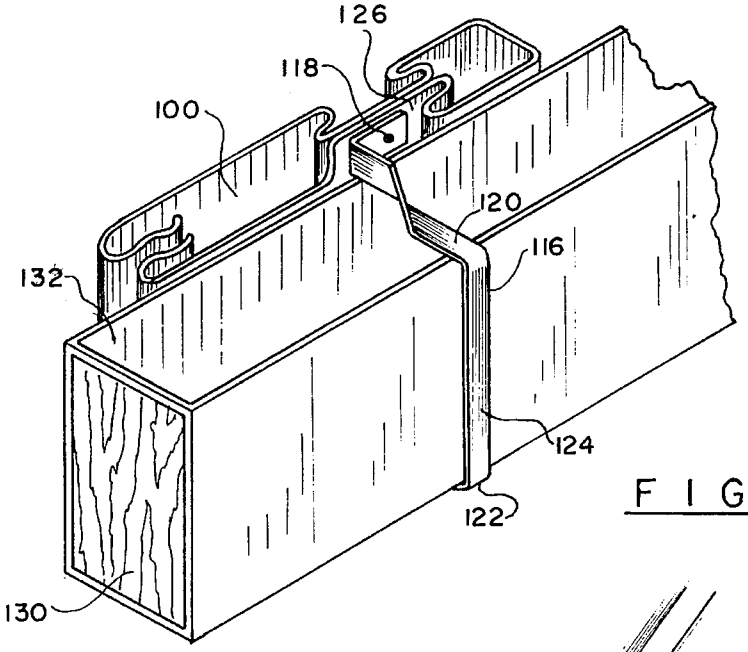
FIG. 5 is a perspective view of a horizontal board utilized in construction of a structure with the use of the module in accordance with the present invention.

As can be seen in FIGS. 5 and 6, the bracket 116 is comprised of a U-shaped member having a pair of parallel opposing portions 120 and 122 interconnected by an elongated plate 124. The portions 120 and 122 are mirror images of each other and are formed as strips of moldable material, for example plastic having transversely extending ends 121, 123. Openings 125, 126 are formed in the ends 121, 123, respectively, to receive a securing element, bolt or rivet, as shown in FIG. 4, therethrough. Position of the construction module 100, as well as the attachment to the bracket 116, is schematically shown in FIG. 5.

Further shown in FIG. 5 is a horizontal rail 130 which can be made of wood or other material. To prevent wood deterioration of the rail, it can be wrapped in a plastic material, for example vinyl, similar to the wrap 132 of FIG. 5. The bracket 116 preserves integrity of the wrap 132, since no nails, screws, bolts or other securing means is forced into the rail 130 through the wrapping 132.

In an alternative arrangement, show in FIG. 7, an opening 138 is formed through the wrapping 134 mounted about a horizontal rail 136. The opening 138 is adapted to similarly receive a securing element, such as a screw or bolt therethrough for attaching the horizontal rail 136 to a vertical post 140. To prevent cracks from forming around the opening 136, the wrapping 134 is protected by silicon fillers which are well known in the industry. In the example shown in FIG. 7, a countersunk bolt 142 is forced through the opening 138, with the bolt capped by a cap 144. It is preferred that the cap is also surrounded by a silicon filler to further insure protection of the wrapping 134 against deterioration. If desired, the wrapping 134 can be provided with a number of openings 146 to allow escape of moisture, thereby preventing weather deterioration of the rail 136.

An end cap 150 is shown in FIG. 8 to comprise an end plate 152 attached to a box-like enclosure 154 which forms a cavity therein (not shown) suitable to receive an end 148 of the rail 136. Once the cap 150 is engaged with the end 148, the sides of the rail 136 become protected, with the plate 152 forming an exterior surface of the rail.

FIGS. 9 and 10 illustrate an alternative finish for the end of the modules, as well as for horizontal rails. The alternative member comprises an elongated U-shaped element 160 which is formed with a pair of parallel sides 162 and 164 connected by an elongated strip 166. A plurality of openings 168 are formed through the sides 162 and 164 to allow securing of the element 160 along the vertical side of the modules, as seen in FIG. 9. Similar elements 160 can be positioned on the opposite end of the structure, as shown in FIG. 9, so as to provide an aesthetically pleasing appearance to the overall construction.

Figure 12:
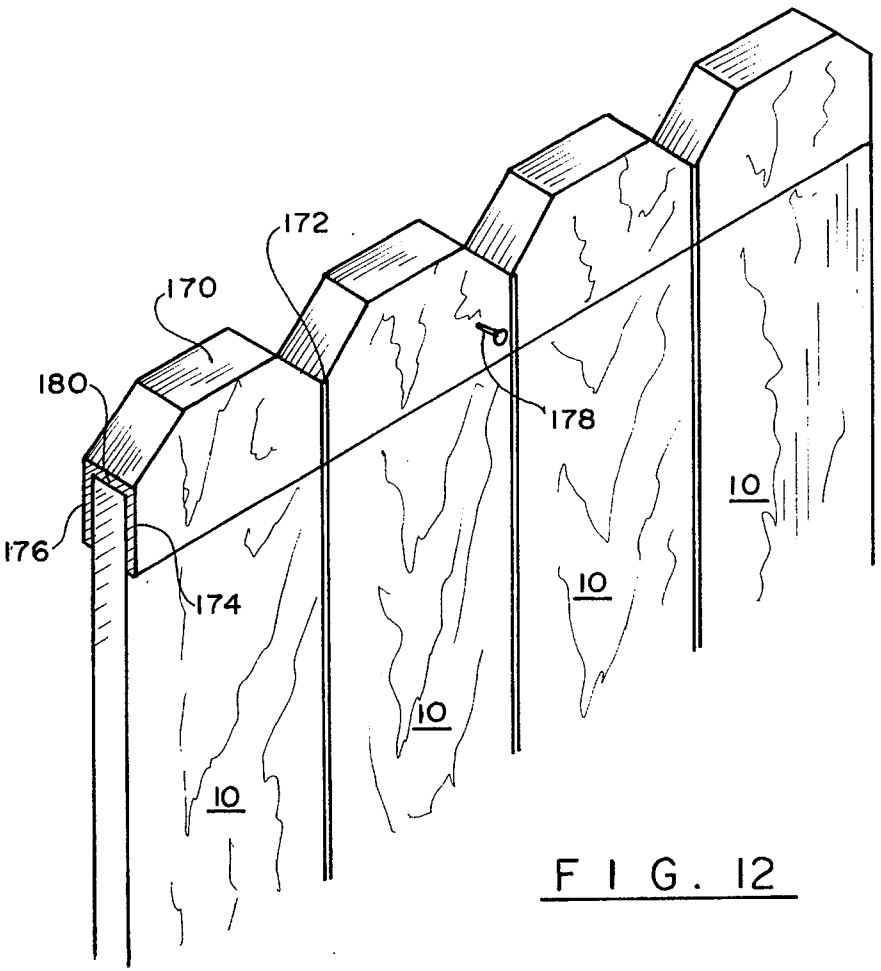
FIG. 12 is a perspective detail view of a fence erected with the modules in accordance with the present invention with a different type of cap.

The top of the fence can be finished with an upper cap element 170, as shown in FIGS. 9 and 12. The cap 170 can be formed as a continuous row of caps or, the row can be separated by cutting along connecting line 172. The shape of the caps 170 can be varied in accordance with the preference of the user. As can be better seen in FIG. 12, each cap 170 comprises downwardly extending parallel side walls 174 and 176 sized to extend below the uppermost edges 180 of the modules 10, **10*a*, respectively. The caps can be secured by a pin, or a bolt, 178 which can be forced through each cap 170** or every other cap, as desired.

Figure 11:
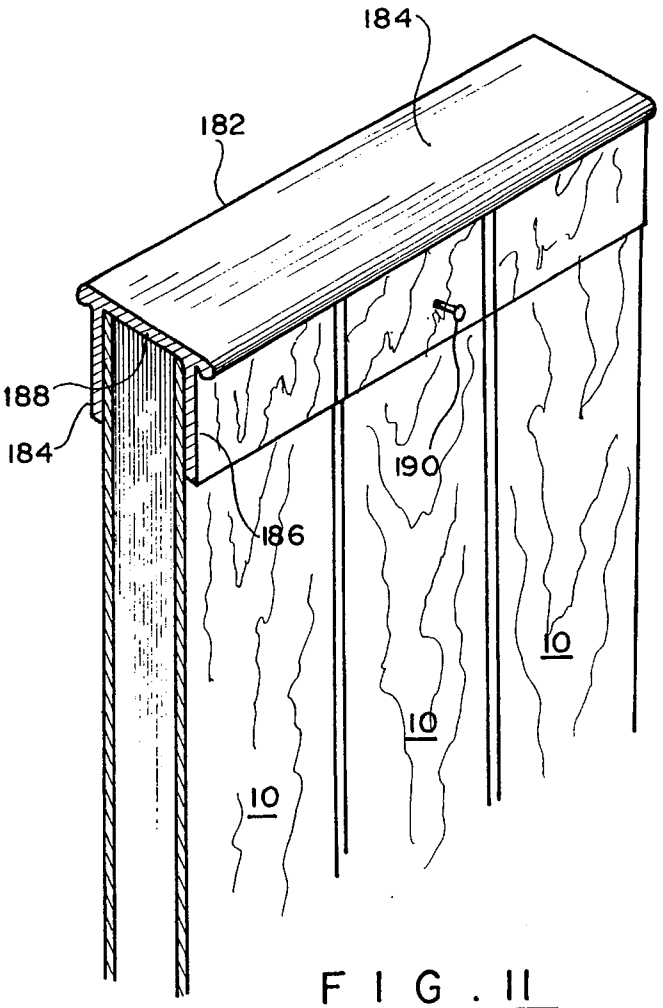
FIG. 11 is a perspective detail view illustrating the use of a continuous cap positioned on a fence erected with the modules in accordance with the present invention.

FIG. 11 illustrates a cap of a different shape, having a continuous flat top 184 from which a pair of opposing sides 186 and 188 extend. The top plate 184 rests on a top edge 180 of the modules 10.

Similarly to the caps of FIG. 12, a pin or a bolt 190 can be used to secure the continuous cap 182 to the sides of the module 10.

As will be apparent to those skilled in the art, the modules 10, **10*a*, 70, 70*a*, 100 and 100*a*** can be made of various dimensions. For example, the plates can be 6 inches long, spaced from each other by about 2 inches, leaving a 2 inch void in the interior of a module. Each module can be manufactured from a single sheet of moldable plastic which is bent or crimped to the desired shape of angular or more rounded designs. The material selected for making the construction modules in accordance with the present invention can be vinyl, or other similar heat-sensitive plastic. Various structures can be constructed from the modules in accordance with the present invention. For example, fences, walls, or siding for existing structures for the purpose of protecting the erected structure from deterioration.

Many changes and modifications can be made in the designs of the present invention without departing from the spirit thereof. I, therefore, pray that my rights to the present invention be limited only by the scope of the appended claims.

I claim:

1. A construction module, comprising:

an elongated sheet of moldable material, said sheet being configured to comprise a first, open-end portion formed by a pair of substantially parallel elements which define a first passageway therebetween, said first portion further comprising a nose portion formed by integral extensions of said elements, said nose portion defining a reduced sized second passageway;

a second, closed end portion which is formed by integral extensions of said elements opposite said nose portion, said closed-end portion adapted to be fitted in a first passageway of a similar adjacent construction module when adjacent construction modules are interconnected; and a connecting portion formed by integral extensions of said elements between said first portion and said second portion, said connecting portion adapted to be fitted into a second passageway of said similar adjacent module when adjacent modules are interconnected, said connecting portion comprising means for allowing securing of the construction module to an independent structure, said means for allowing securing of the construction module comprising a plurality of openings spaced along said connecting portion, said openings being adapted to receive a securing member therethrough.

2. The module of claim 1, wherein said nose portion is formed by converging extensions of said elements opposite said closed end portion.

3. The module of claim 2, wherein said converging extensions have outwardly extending tips.

4. The module of claim 3, wherein each of said extensions forming said closed end portion is formed with a groove adjacent said connecting portion.

5. The module of claim 4, wherein said tips fit into grooves of the adjacent module.

6. A construction module, comprising:

an elongated sheet of moldable material, said sheet configured to comprise a first, open-end portion formed by a pair of substantially parallel elements which define a first passageway therebetween, said first portion further comprising a nose portion formed by integral extensions of said elements, said nose portion defining a reduced size second passageway;

a second, closed end portion which is formed by integral extensions of said elements opposite said nose portion, said closed-end portion adapted to be fitted in a first passageway of a similar adjacent construction module when adjacent construction modules are interconnected; and a connecting portion formed by integral extensions of said elements between said first portion and said second portion, said connecting portion adapted to be fitted into a second passageway of said similar adjacent module when adjacent modules are interconnected, said connecting portion comprising means for allowing securing of the construction module to an independent structure, said means for allowing securing of the construction module comprising a plurality of openings formed along said connecting portion in opposing elements, said openings being adapted to receive a securing member therethrough, and wherein each of said extensions forming said closed end portion is formed with a groove adjacent said connecting portion.

7. The module of claim 6, wherein said nose portion comprises have outwardly extending tips, and wherein said tips fit into grooves of said extensions that form the closed end portion of said similar adjacent construction module.

8. A construction module, comprising:

an elongated sheet of moldable material, said sheet configured to comprise a first, open end portion formed by a pair of spaced-apart elements which define a first passageway therebetween, said first portion further comprising a nose portion formed by integral extensions of said elements, said nose portion defining a reduced size second passageway;

a second, closed end portion which is formed by integral extensions of said elements opposite said nose portion, said closed end portion adapted to be fitted in a first passageway of a similar adjacent construction module when adjacent construction modules are interconnected; and a third, connecting portion formed by integral extensions of said elements between said first portion and second portion, said third portion adapted to be fitted into a second passageway of said similar adjacent module when adjacent modules are interconnected, said connecting portion being provided with means for allowing securing of the construction module to an independent structure, said means for allowing securing comprising a plurality of openings spaced along said connecting portion, said opening being adapted to receive a securing member therethrough.

9. The module of claim 8, wherein said second passageway is formed by converging extensions of said elements which extend inwardly into said first passageway to define a reduced width passageway which forms an open end of said construction module.

10. The module of claim 9, wherein each of said extensions forming said closed end portion of said construction module is formed with a groove adjacent said connecting portion.

11. The module of claim 10, wherein said inwardly extending converging extensions have outwardly extending tips which fit into grooves of the adjacent construction module.

* * * * *